US005308209A

United States Patent [19]

Crudo et al.

[11] Patent Number: 5,308,209

[45] Date of Patent: May 3, 1994

[54] BINDING MACHINE WITH DEBINDER

[75] Inventors: Phillip M. Crudo; Luis de Leon, both of Sparks, Nev.

[73] Assignee: VeloBind, Inc., Sparks, Nev.

[21] Appl. No.: 981,622

[22] Filed: Nov. 25, 1992

[51] Int. Cl.[5] ..... B42C 17/00

[52] U.S. Cl. ..... 412/15; 412/12; 412/41; 412/43

[58] Field of Search ..... 412/12, 15, 41, 43

[56] References Cited

U.S. PATENT DOCUMENTS

| | | | |
|---|---|---|---|
| 3,431,537 | 6/1961 | Klingenberg | 24/224 |
| 3,452,376 | 7/1969 | Ito | 412/43 X |
| 3,756,625 | 9/1973 | Abilgaard | 281/25 |
| 3,811,146 | 5/1974 | Abilgaard | 11/1 |
| 4,270,970 | 6/1981 | Szanto | 156/11 |
| 5,118,238 | 6/1992 | Crudo | 412/15 |

*Primary Examiner*—Paul A. Bell

*Attorney, Agent, or Firm*—Julian Caplan; Edward N. Bachand

[57] ABSTRACT

A debinding apparatus for inclusion in a machine adapted to bind together sheets formed with first apertures spaced longitudinally on one edge thereof. The machine uses a first narrow thermoplastic strip which has studs projecting therefrom and spaced complementary to the first apertures in the sheets and a second narrow strip formed with second apertures spaced complementary to the first apertures in the sheets. The machine has a frame and a platen for supporting the second strip with the sheets superimposed on the second strip and the studs of the first strip extending through the first and second apertures and protruding below the second strip. In addition, the machine includes a plurality of cutting elements, heating elements for heating the cutting elements, and a mechanism for moving the cutting elements to cut off excess stud length and to initiate the formation of heads on the ends of the studs. The machine also has an assembly for forming heads on the ends of the studs which includes a plurality of fingers for engaging the ends of the stud and a mechanism for actuating the fingers from an inoperative to an operative position. The improvement to the machine comprises a debinding apparatus which disengages the mechanism for actuating the fingers so that after the cutting elements soften the heads the fingers do not cool the heads, thereby facilitating separation of the strips and sheets. A switch initiates the debinding apparatus.

10 Claims, 3 Drawing Sheets

BINDING MACHINE WITH DEBINDER

BACKGROUND OF THE INVENTION

1. Field of the Invention

This invention relates to an improvement to a binding machine and, more specifically, to a binding machine which binds documents using plastic strips.

2. Prior Art

This invention relates to a debinding apparatus for commercially available binding machines. Reference is made to U.S. Pat. No. 4,270,970 on a sheet binding apparatus. Generally, the system disclosed therein is for binding together, either temporarily or permanently, pluralities of sheets of paper. Each of the sheets is formed with a series of spaced apertures adjacent one margin thereof. The system uses a first strip having studs which correspond in spacing to the apertures in the sheets and a second strip formed with holes to receive the studs which are aligned with the apertures in the sheets. The machine incorporates a pressure bar which applies pressure on the sheets of paper while pressing the strips toward each other. A plurality of heated cutting elements, one for each stud, cuts off the excess lengths of the studs and initiates the formation of heads on the ends of the studs. An equal plurality of fingers engage the heated ends of the studs to form rivet heads thereon and to then cool the studs. These machines have proven commercially successful.

Binding machines have been provided with debinding functions. In this regard, see U.S. Pat. No. 3,756,625 where the machine's cycle can be stopped for a period of time for melting the rivet heads at the point where the heated cutting elements are closest to the rivet heads. When the cycle is resumed, however, the cooling fingers engage the ends of the studs to reform rivet heads and cool the plastic studs before the sheets can be removed from the machine for separation. The reformed rivet heads hinder debinding of the sheets.

Accordingly, a primary object of the present invention is to provide a binding machine using plastic strips which includes an apparatus for debinding of previously bound sheets.

Another object of the invention is to provide a binding machine of the above character which includes heated cutting elements which in the debinding cycle serve to soften the rivet heads previously formed on the ends of the studs during the binding cycle.

Another object of the invention is to provide a binding machine of the above character which in the debinding cycle deactivates the cooling fingers used during the binding cycle.

SUMMARY OF THE INVENTION

In general, the invention is a debinding apparatus for inclusion in a machine adapted to bind together sheets formed with first apertures spaced longitudinally on one edge thereof. The machine uses a first narrow thermoplastic strip which has studs projecting therefrom and spaced complementary to the first apertures in the sheets and a second narrow strip formed with second apertures spaced complementary to the first apertures in the sheets. The machine has a frame and means for supporting the second strip with the sheets superimposed on the second strip and the studs of the first strip extending through the first and second apertures and protruding below the second strip. In addition, the machine includes a plurality of cutting elements, means for heating the cutting elements, and actuating means for moving the cutting elements to cut off excess stud length and create an end thereon and to initiate the formation of heads on the ends of the studs. The machine also has means for forming heads on the ends of the studs which includes a plurality of fingers for engaging the stud ends and movement means for actuating the fingers from an inoperative to an operative position.

The improvement to the machine comprises debinding means for disengaging the movement means for actuating the fingers to facilitate separation of the strips and sheets and means manually operable to initiate the debinding means.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Figure 1:
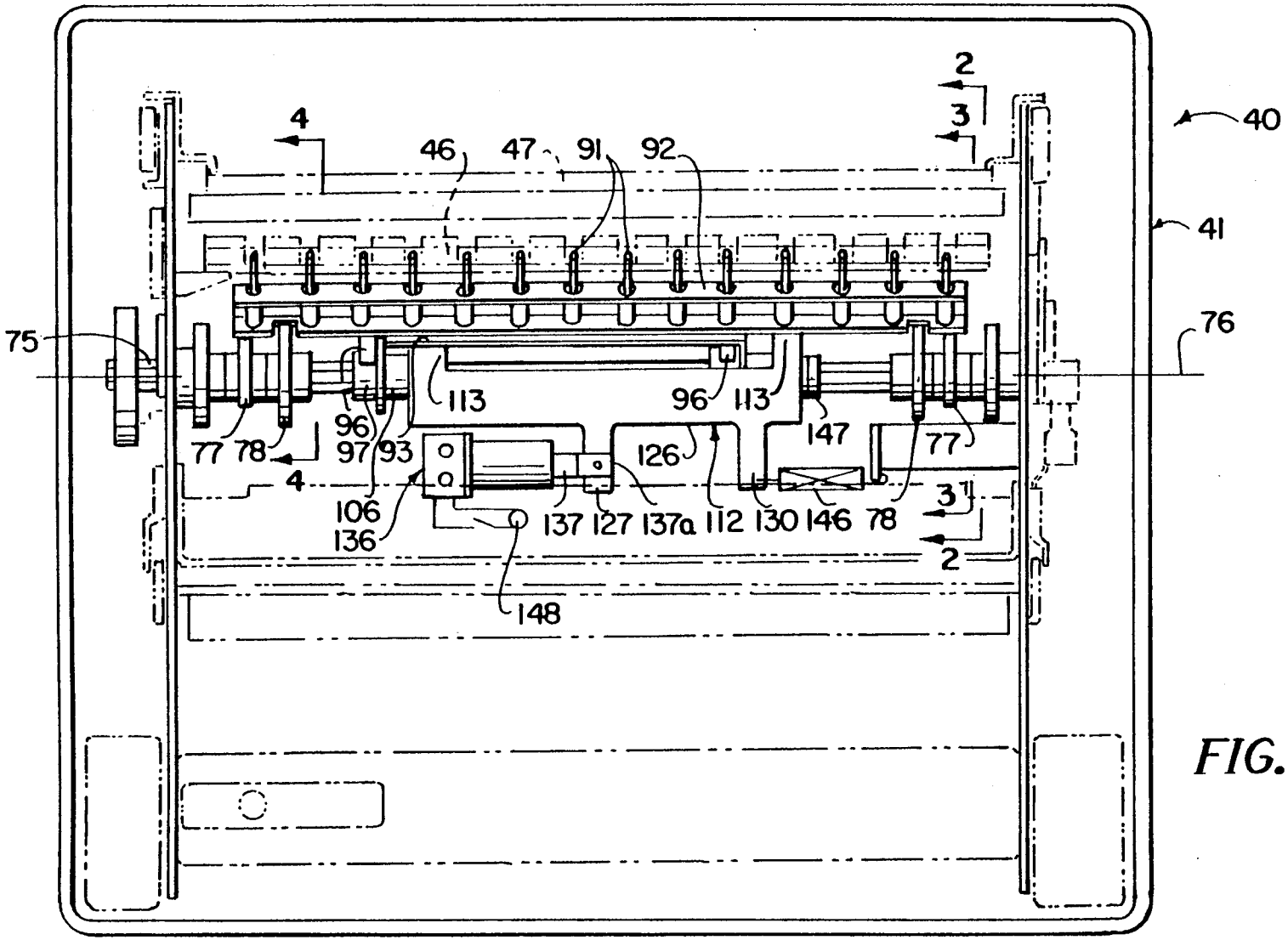
FIG. 1 is a top plan view of the debinding apparatus of the present invention.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Turning now to the drawings, wherein like components are designated by like reference numerals throughout the various figures, attention is directed to FIGS. 1 through 8.

The system of binding to which the improvement of the present invention relates is disclosed in U.S. Pat. No. 4,270,970. The improvement is used with sheets of paper 21 formed with first apertures 22 spaced longitudinally on one spine edge 23 thereof (See FIG. 4). There is also used a first narrow thermoplastic strip 26 having a plurality of studs 27 projecting therefrom which are spaced along the length thereof complementary to first apertures 22, and a second narrow thermoplastic strip 28 formed with a plurality of second apertures 31 and counterbores or countersinks 32 spaced along the length thereof complementary to first apertures 22.

The improvement can be used with a binding machine 40 of the type described in U.S. Pat. No.

Figure 4:
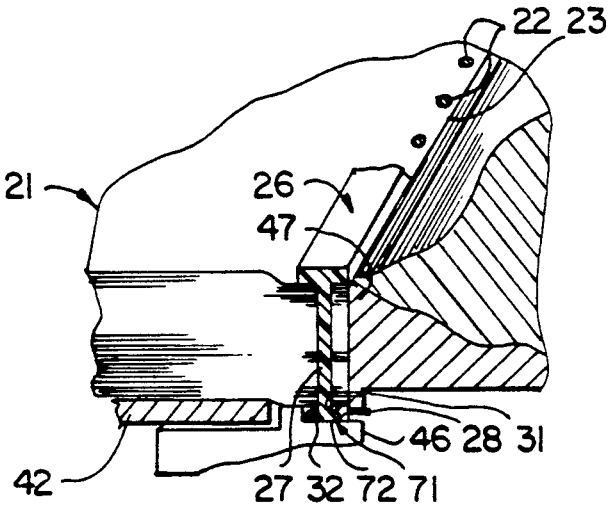
FIG. 4 is a fragmentary isometric and cross-sectional view taken substantially along the line 4—4 of FIG. 1.

4,270,970. Machine 40 is adapted to bind paper 21 together and includes a frame or casing 41 and a binding platen 42 supported thereby which extends horizontally across the width of the machine (See FIGS. 1, 2 and 4). Paper 21 rests on platen 42 during binding as illustrated in FIG. 4. Platen 42 is provided with a depression or recess 43 at its rearward edge which is at the level of the top of a transverse bridge 46. Recess 43 is shaped to receive second strip 28. Rearward of recess 43 is a stop 47 which limits inward movement of paper 21 resting on platen 42. Platen 42, bridge 46 and stop 47 serve as means for supporting second strip 28 with paper 21 superimposed on the second strip and first strip 26 superimposed on the paper, studs 27 extending through first and second apertures 22 and 31 and protruding below second strip 28.

Figure 2:
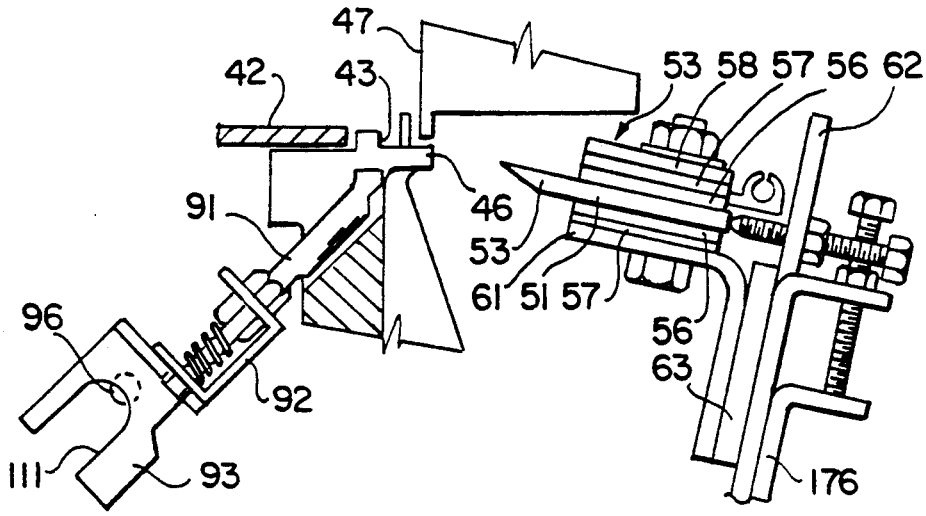
FIG. 2 is a fragmentary cross-sectional view taken substantially along the line 2—2 of FIG. 1.

Machine 40 includes cutter 51 having a plurality of cutting elements in the form of blades 52 for trimming the excess portion of studs 27 (See FIG. 2). Cutter 51 is carried by a knife structure 53 mounted behind recess 43, with blades 52 projecting forwardly and being spaced apart about the same distance as studs 27. Above and below cutter 51 in knife structure 53 are heating elements 56 which serves as means for heating blades 52. Above and below each heating element 56 is an insulator 57, and on top of top insulator 57 is a cover 58. Below the lower insulator 57 is a support bar 61, with a support bracket 62 being attached to support bar 61 and being insulated therefrom by a high temperature insulator 63. Each support bracket 62 is connected to a pivot arm 66 which is pivoted about transverse eccentric shaft 67 (See FIG. 5).

Figure 3:
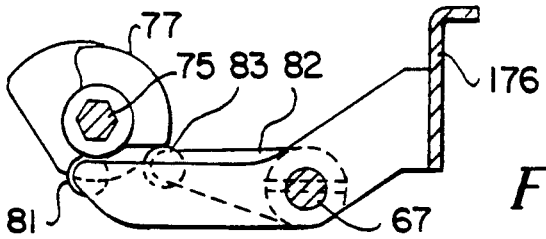
FIG. 3 is fragmentary cross-sectional view taken substantially along the line 3—3 of FIG. 1.

Actuating means is provided in machine 40 for moving blades 52 to cut off the excess length of studs 27 and create an end 71 thereon and to initiate the formation of rivet heads 72 on stud ends 71 and includes a drive transverse horizontal elongated camshaft 75 which extends along an axis 76 and is hexagonal in cross-section (See FIGS. 1 and 3). Camshaft 75 is rotatably carried by casing 41 and has a first or cutter cam 77 mounted on each end thereof and a second or lift cam 78 also mounted on each end thereof adjacent and inwardly the respective cutter cam 77. On the forward ends of pivot arms 66 are first or cutter cam followers 81 which ride on cutter cams 77. Cutter cams 77 cause knife structure 53 to move about eccentric shaft 67 as a center and heated blades 52 to cut off the excess lengths of studs 27. Extending forwardly near each end of eccentric shaft 67 is a lift arm 82 carrying at its forward end a second or lift cam follower 83 which rides on the respective lift cam 78 on camshaft 75. Lift cams 78 cause knife structure 53 to be raised to deform the heated stud ends 71 and initiate the forming of rivet heads 72 thereon. Knife structure 53, with pivot arm 66, and lift arm 82 serve as means for interconnecting cutter and lift cam followers 81 and 83 to blades 52.

A plurality of cooling fingers 91 for engaging stud ends 71 are carried by casing 41. Cooling fingers 91 are spaced transversely of machine 40 to correspond to studs 27 and are part of the means for forming rivet heads 72 on stud ends 71. The cooling fingers 91 are carried by a channel 92 which has a bracket 93 extending forwardly from each end thereof. Each of the two brackets 93 carries on its forward end a third or cooling cam follower 96 which rides on a third or cooling cam 97. Cooling cams 97 are mounted in longitudinally spaced apart position on camshaft 75 near and substantially equidistant from the center of camshaft 75. Channel 92 acts as means for interconnecting cooling cam followers 96 to cooling fingers 91. As camshaft 75 rotates, cam followers 96 riding on cooling cams 97 cause channel 92 to move cooling fingers 91 upwardly and rearwardly from an inoperative position to an operative position, with camshaft 75, cooling cams 97, cooling cam followers 96 and channel 92 comprising part of the movement means for so actuating cooling fingers 91. When cooling fingers 91 are in said operative position, they engage stud ends 71 to set rivet heads 72 and to cool the same so that strips 26 and 28 are rivetted together a fixed distance apart.

For a more detailed description of the foregoing and a description of the various components discussed above or otherwise included in machine 40, the relevant terms and provisions of U.S. Pat. No. 4,270,970 are hereby incorporated herein by this reference.

The debinding apparatus for machine 40 comprises debinding means for disengaging the movement means for actuating cooling fingers 91 and, by doing so, facilitating the separation of first and second plastic binding strips 26 and 28 and paper 21. In this regard, means is provided for causing relative movement between cooling cam followers 96 and cooling cams 97 from a first position where cam followers 96 ride on cooling cams 97, as illustrated in FIG. 5, and a second position where cam followers 96 do not ride on cooling cams 97, as illustrated in FIG. 6.

Figure 5:
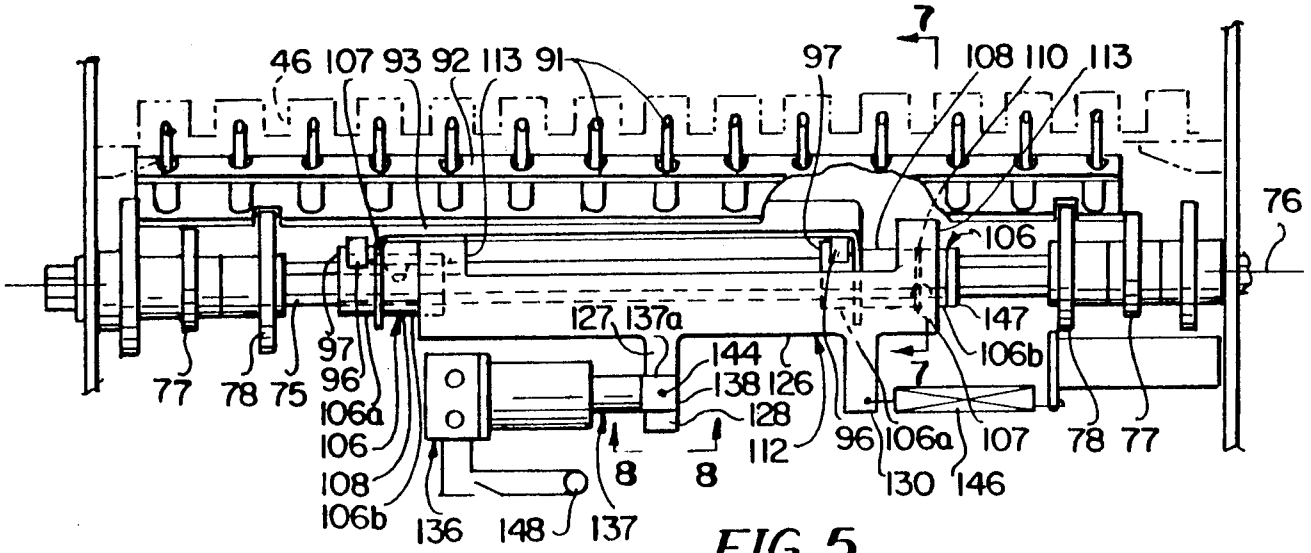
FIG. 5 is an enlarged top plan view of a portion of the apparatus shown in FIG. 1.
Figure 6:
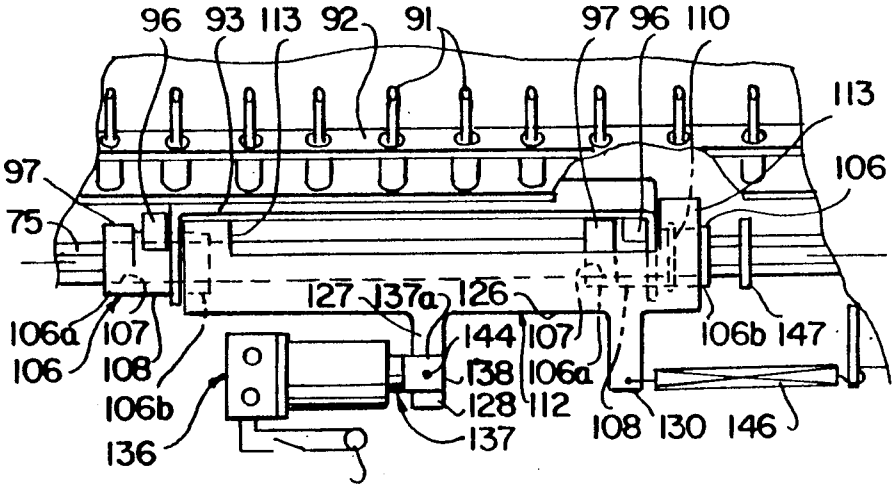
FIG. 6 is an enlarged top plan view, similar to FIG. 5, of a portion of the apparatus shown in FIG. 1.

Tubular sleeves 106 having opposite first and second end portions **106*a* and 106*b*, with cooling cams 97 being formed on first end portion 106*a*, are provided in improved machine 40 (See FIGS. 5 and 6). Sleeves 106 each have a bore 107 which is hexagonal in cross-section and dimensioned to cooperatively receive camshaft 75. Bores 107 act as means for slidably mounting cooling cams 97 on camshaft 75 for movement between first positions engaging cooling cam followers 96 and second positions not engaging the cooling cam followers. Second end portion 106*b* of each sleeve 106 has an outer surface 108 which is generally circular in cross-section, with a radial dimension equivalent to the smallest outer radial dimension of the respective cooling cam 97, and is formed with an annular groove 110 therein. Sleeves 106 are mounted in longitudinally spaced apart position on camshaft 75 near and substantially equidistant from the center of camshaft 75, and are aligned so that first end portions 106*a* are each closer one side of casing 41 and second end portions 106*b* are each closer the other opposite side of casing 41**.

Each cooling cam follower 96 rides on the respective cooling cam 97 in substantially the same manner as disclosed in U.S. Pat. No. 4,270,097, except that the related bracket 93 on channel 92 is provided with a bifurcation 111 which is larger in size than the similar bifurcation, designed to straddle camshaft 75, disclosed in U.S. Pat. No. 4,270,097. Bifurcation 111 is sized to straddle outer surface 108 of sleeve 106 as cooling cam 97 moves between its first and second positions discussed above, with cooling cam follower 96 extending into bifurcation 111 so as to ride on either cooling cam 97 or outer surface 108 at all times.

A bracket 112 with first and second arms 113 facing rearwardly engages sleeves 106. Arms 113 are each provided with a slot 116 formed between prongs 117 at the end thereof. Slots and prongs 116 and 117 act as means for coupling bracket 112 to cooling cams 97 to permit rotation of the cooling cams with camshaft 75 relative to the bracket. Each sleeve 106 is disposed in a slot 116 and the related prongs 117 straddle the sleeve and ride in annular groove 110 formed in outer surface 108 thereof (See FIGS. 5 and 7). Arms 113 are interconnected by bracket cross member 126 which has a stem 127 projecting forwardly from the center thereof. Stem 127 has a generally horizontal flat 128 on the end thereof with a generally vertical bore therethrough formed by an inner surface 129 which is circular in cross-section. Cross member 126 also has a retention arm 130 projecting forwardly near one end thereof.

A transversely disposed solenoid 136 is carried by casing 41 and has an armature 137 movable in a direction substantially parallel with axis 76 between a first deenergized position, where the armature is in an extended position as shown in FIG. 5, and a second energized position, where the armature is in a retracted position as shown in FIG. 6. Armature 137 has an end portion 137*a* provided with vertically spaced apart first or upper and second or lower generally horizontal flats 138 and 141 which form a slot 142 in end portion 137*a*.

Figure 8:
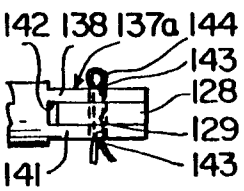
FIG. 8 is a front elevational view taken along the line 8—8 of FIG. 5.
Figure 7:
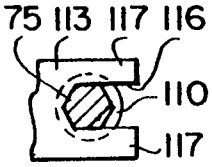
FIG. 7 is a fragmentary cross-sectional view taken substantially along the line 7—7 of FIG. 5.

Slot 142 is configured and dimensioned to receive bracket flat 128, with bracket flat 128 being sandwiched between armature flats 138 and 141 (See FIG. 8). Flats 138 and 141 have generally vertical bores therethrough which are formed by generally circular-shaped respective inner surfaces 143 and are aligned with the bore formed by inner surface 129 in stem 127. A cotter pin 144 is disposed through the bores in flats 138, 128 and 141 and engages respective bore-forming inner surfaces 129 and 143 so that bracket 112 moves transversely in casing 41 and cooling cams 97, which are longitudinally locked with bracket 112 by prongs 117 riding in sleeve annular grooves 110, move longitudinally on camshaft 75 as solenoid 136 is energized. In this manner, inner surfaces 129 and 143 and cotter pin 144 act as means for connecting armature 137 to bracket 112 for movement of cooling cams 97 between the first and second positions discussed above. In the first position, cooling cam followers 96 ride on cooling cams 97, while in the second position, cooling cam followers 96 do not ride on cooling cams 97.

A transverse resilient means in the form of spring 146 is attached at one end to the end of forwardly projecting retention arm 130 and at the other end to casing 41 for biasing armature 137 from its second energized position to its first deenergized position. An annular limit ring 147 is carried by camshaft 75 to limit the spring 146 induced travel of bracket 93 and cooling cams 97. Limit ring 147 is longitudinally positioned on camshaft 75 so that one of the cooling cams 97 abuts the limit ring when cooling cams 97 are in their first position with cooling cam followers 96 riding thereon. Spring 146 and limit ring 147 act to retain armature 137 in its deenergized position.

The debinding apparatus for machine 40 also includes a manual switch 148 which acts as means operable to energize solenoid 136 and thereby to initiate the debinding means discussed above. When deactivated, switch 148 serves to deenergize solenoid 136.

In use as a debinder, machine 40 with the debinding apparatus of the present invention included therein is operated in a manner similar to the operation of machine 40 in its binding mode. Bound paper 21 having first and second strips 26 and 27 thereon is placed on binding platen 42 with second strip 27 disposed in recess 43. Activation of switch 148 energizes solenoid 136, causing cooling cams 97 to move out from under and generally cylindrical outer surface 108 to move under cooling cam followers 96. With switch 148 so activated, cooling cam followers 96 remain on outer surface 108 throughout the cycle of machine 40 and, by doing so, deactivate cooling fingers 91 during the cycle. The binding cycle of machine 40 is now converted to a debinding cycle.

In the debinding cycle, knife structure 53 operates in the same manner as it does in the binding cycle. Cutter cam followers 81 riding on cutter cams 77 cause knife structure 53, with heated blades 52 thereon, to pivot about eccentric shaft 67 to a position below rivet heads 72. Lift cam followers 83 on lift cams 78 thereafter cause heated blades 52 to be raised for engagement with or for positioning in close proximity to rivet heads 72. Heated blades 52 cause rivet heads to soften and deform.

With cooling fingers 91 deactivated, machine 40 continues through its cycle without cooling the now melted and deformed stud ends 71. Upon removal of paper 21 from machine 40, studs 27 are pulled through countersinks 32 and second apertures 31 to permit separation of paper 21. This separation is facilitated by the debinding apparatus of the present invention as the now deformable stud ends 71 can be more easily pulled past countersinks 32 than stud ends 71 that have been cooled and resolidified, in many instances with reformed rivet heads 72 thereon, by cooling fingers 91.

Once debinding is completed, switch 148 is deactivated causing solenoid 136 to be deenergized and cooling cams 97, with the assistance of spring 146, to return to their first position in engagement with and under cooling cam followers 96. Limit ring 147 serves to limit the travel of cooling cams 97 on camshaft 75 so that they do not move beyond their first position in engagement with cooling cam followers 96.

It is apparent from the foregoing that a binding machine using plastic strips has been provided which includes an apparatus for debinding of previously bound sheets. The machine has heated cutting elements which in the debinding cycle serve to melt the rivet heads previously formed on the ends of the studs during the binding cycle. In the debinding cycle, the machine deactivates the cooling fingers used during the binding cycle.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, and to thereby enable others skilled in the art to best utilize the invention and various embodiments with various modifications as are suited to the particular use contemplated. It is intended that the scope of the invention be defined by the claims appended hereto and their equivalents.

What is claimed is:

1. A debinding apparatus for a machine adapted to bind together sheets formed with first apertures spaced longitudinally on one edge thereof using a first narrow thermoplastic strip having studs projecting therefrom spaced complementary to said first apertures and a second narrow strip formed with second apertures spaced complementary to said first apertures, said machine comprising a frame, means for supporting said second strip with said sheets superimposed on said second strip and said first strip superimposed on said sheets with said studs extending through said first apertures and said second apertures and protruding below said second strip, a plurality of cutting elements, means for heating said cutting elements, actuating means for moving said cutting elements to cut off excess stud length and create an end thereon and to initiate the formation of heads on the ends of said studs, and means for forming heads on the ends of said studs which includes a plurality of fingers for engaging said ends and movement means for actuating said fingers from an inoperative to an operative position, the improvement comprising debinding means for disengaging said finger movement means to facilitate separation of said strips and sheets and means operable to initiate said debinding means.

2. An apparatus according to claim 1 wherein said cutting element actuating means includes a transverse axially elongated camshaft rotatably carried by said frame, first and second cams mounted on said camshaft with first and second cam followers riding thereon, and means for interconnecting said first and second cam followers to said cutting elements so that the cutting elements can cut off excess stud length and can initiate the formation of heads on the ends of the studs.

3. An apparatus according to claim 1 wherein said finger movement means includes a transverse axially elongated camshaft rotatably carried by said frame, a first cam mounted on said camshaft with a first cam follower riding thereon, and means for interconnecting said first cam follower to said fingers, said fingers moving upwardly and rearwardly from an inoperative position to an operative position.

4. An apparatus according to claim 3 wherein said debinding means includes means for causing relative movement between said first cam follower and said first cam from a first position where said first cam follower rides on said first cam to a second position where said first cam follower does not ride on said first cam.

5. An apparatus according to claim 4 wherein said relative movement means includes means for slidably mounting said first cam on said camshaft for movement between a first position engaging said first cam follower and a second position not engaging said first cam follower.

6. An apparatus according to claim 5 wherein said relative movement means further includes a bracket, means for coupling said bracket to said first cam to permit rotation of said first cam with said camshaft relative to said bracket, a transversely mounted solenoid on said frame with an armature movable between a first deenergized position and a second energized position, and means for connecting said armature to said bracket for movement of said first cam between said first and second positions.

7. An apparatus according to claim 6 which further comprises resilient means coupled to said bracket biasing said armature to said deenergized position.

8. An apparatus according to claim 6 further comprising first and second cams, means for slidably mounting said cams on said camshaft in a longitudinally spaced apart position, first and second cam followers riding on said first and second cams, means for interconnecting said first and second cam followers to said fingers, a bracket having first and second arms, and means for coupling said first and second bracket arms to said first and second cams to permit rotation of said cams with said camshaft relative to said bracket.

9. An apparatus according to claim 1 wherein said initiation means includes a manual switch.

10. A debinding apparatus for a machine adapted to bind together sheets formed with first apertures spaced longitudinally on one edge thereof using a first narrow thermoplastic strip having studs projecting therefrom spaced complementary to said first apertures and a second narrow strip formed with second apertures spaced complementary to said first apertures, said machine comprising a frame, means for supporting said second strip with said sheets superimposed on said second strip and said first strip superimposed on said sheets with said studs extending through said first apertures and said second apertures and protruding below said second strip, a plurality of cutting elements, means for heating said cutting elements, actuating means for moving said cutting elements to cut off excess stud length and create an end thereon and to initiate the formation of heads on the ends of said studs, and means for forming heads on the ends of said studs which includes a plurality of fingers for engaging said ends and movement means for actuating said fingers from an inoperative to an operative position comprising a transverse axially elongated camshaft rotatably carried by said frame, a first cam mounted on said camshaft, a first cam follower riding on said first cam and means for interconnecting said first cam follower to said fingers, the improvement comprising means for causing relative movement between said first cam follower and said first cam from a first position where said first cam follower rides on said first cam to a second position where said first cam follower does not ride on said first cam, said relative movement means including means for slidably mounting said first cam on said camshaft for movement between a first position engaging said first cam follower and a second position not engaging said first cam follower, a bracket, means for coupling said bracket to said first cam to permit rotation of said first cam with said camshaft relative to said bracket, a solenoid carried by said frame with an armature movable between a first deenergized position and a second energized position, means for connecting said armature to said bracket for movement of said first cam between said first and second positions, and means operable to energize said solenoid.

* * * * *